US006003816A

United States Patent [19]

Lee

[11] Patent Number: 6,003,816

[45] Date of Patent: Dec. 21, 1999

[54] 3D KITE

[76] Inventor: Jen-An Lee, No.69, Wen Chang Road, Kaohsiung, Taiwan

[21] Appl. No.: 09/173,024

[22] Filed: Oct. 15, 1998

[51] Int. Cl.[6] ..... B64C 31/06

[52] U.S. Cl. ..... 244/153 R; 154/155 R

[58] Field of Search ..... 244/153 R, 154, 244/155 R, 155 A

[56] References Cited

U.S. PATENT DOCUMENTS

| | | | |
|---|---|---|---|
| 606,960 | 7/1898 | Doyle | 244/153 R |
| 666,427 | 1/1901 | Lamson | 244/154 |
| 1,666,813 | 4/1928 | Eddy | 244/154 |
| 3,326,392 | 6/1967 | Rock | 244/153 R |
| 3,711,045 | 1/1973 | Holland, Jr. | 244/153 R |
| 4,450,784 | 5/1984 | Mellinger | 244/153 R |
| 4,557,443 | 12/1985 | Christoffel, Jr. | 244/153 R |
| 5,417,390 | 5/1995 | Southwick | 244/153 R |
| 5,727,756 | 3/1998 | Rowe | 244/153 R |
| 5,893,537 | 4/1999 | Lee | 244/153 R |

*Primary Examiner*—Galen L. Barefoot
*Attorney, Agent, or Firm*—Rosenberg, Klein & Lee

[57] ABSTRACT

A 3D kite includes two upright rods mutually connected with each other with a cloth strip or a rope, a horizontal rod fixed with lower ends of the two upright rod, a sail attached on an outer side of each upright rod and kept secured by means of an insert block connected to an outer corner of the sail and inserted in two ends of the horizontal rod, and a plurality of wings fixed horizontally between the two upright rods.

15 Claims, 11 Drawing Sheets

3D KITE

BACKGROUND OF THE INVENTION

This invention relates to a 3D kite, particularly to one having a new structure of three dimensions.

Kites have been developed from simple ones to 3D so as to satisfy curiosity of players, as old simple ones are unlikely to gratify consumers' mind of chasing after new things.

A known conventional 3D kite includes a body 10, two upright rods 20 and plural wings 30 combined together.

The body 10 has plural support rods 101 bound with strings to form the body 10, two combining holes 102 for a lower end of two upright rods 20 to fit therein firmly. Each support rod 101 has a connector 100 and a position ring 103 for another support rod 101 to insert and connect with each other. Further, a string 201 is used to tie each upright rod 20 to the body 10 for helping secure each upright rod 20 to the body 10. The string 201 has a position ring 202 at its end to fit with a front end and a rear end of the body 10. Further, an auxiliary wing 203 is attached to each upright rod 20 for receiving wind. One or more hooks 204 are fixed spaced apart on each upright rod 20 so as to fix two horizontal rods 301 of each wing 30 with the hooks 204. And each wing 30 has two horizontal rods 301, and a cloth 302 attached with the two horizontal rods 301 for receiving wind. The horizontal rods 301 are vertical to the upright rods 20, respectively having a thick section 303 to tightly engage the hook 204. Further, a string 304 is tied on each horizontal rod 301, having an upper end tied with an upper end of each upright rod 20 and the lower end tied with the support rod 201 of the body 10, by means of a ring 305 attached with the lower end for the support rod 101 to pass through. Then this conventional 3D kite is done in its assemblage.

However, this conventional 3D kite is quite complicated, taking much time to construct.

SUMMARY OF THE INVENTION

A main purpose of the invention is to offer a simpler 3D kite, consisting of two upright rods, a horizontal rod fixed with lower ends of the two upright rods, a sail attached with each upright rod, an insert block connected to an outer corner of each sail and inserted in two ends of the horizontal rod to secure the two upright rods on the horizontal rod, and a plurality of wings horizontally fixed between the two upright rods.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
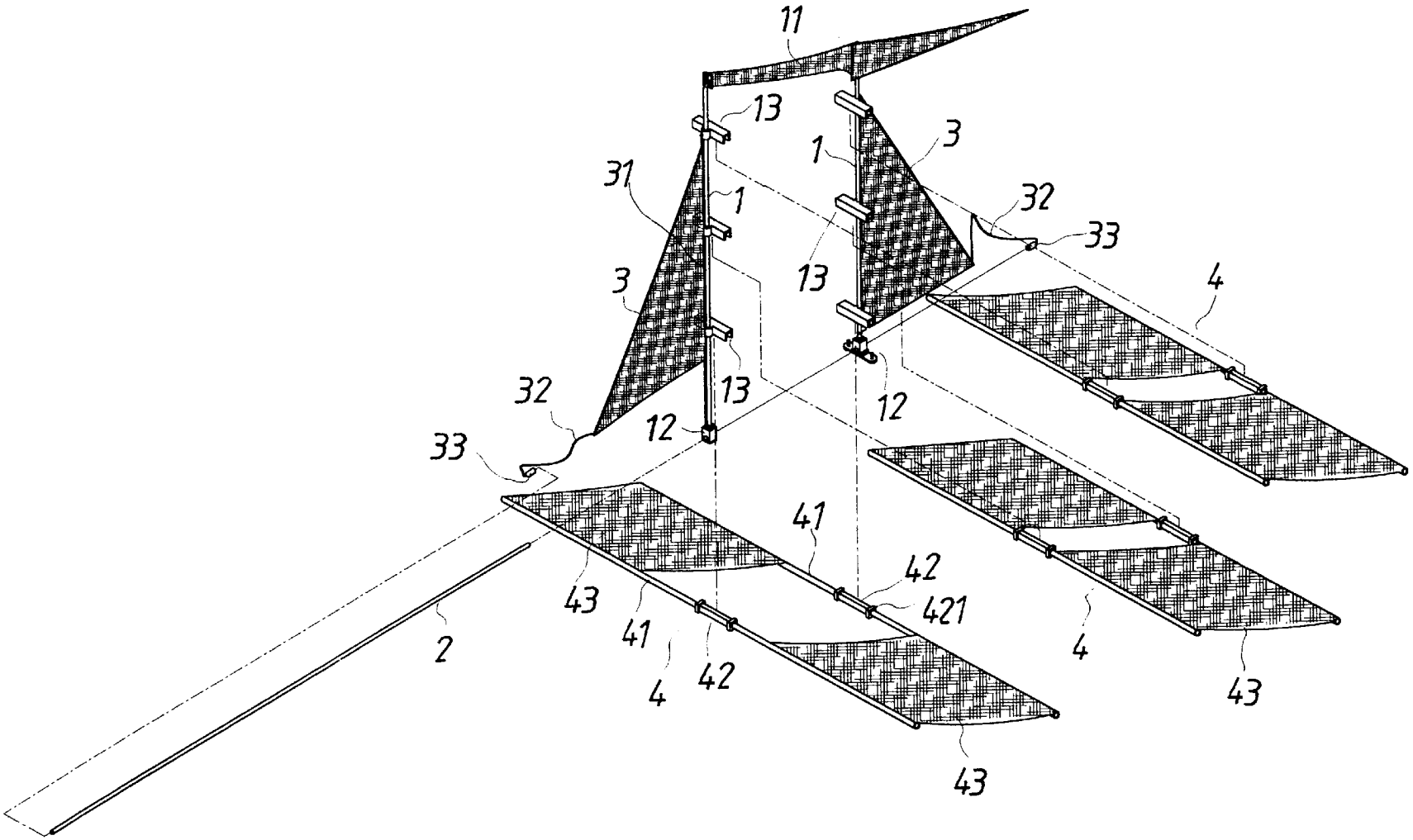
FIG. 1 is an exploded perspective view of a 3D kite of the present invention.
Figure 2:
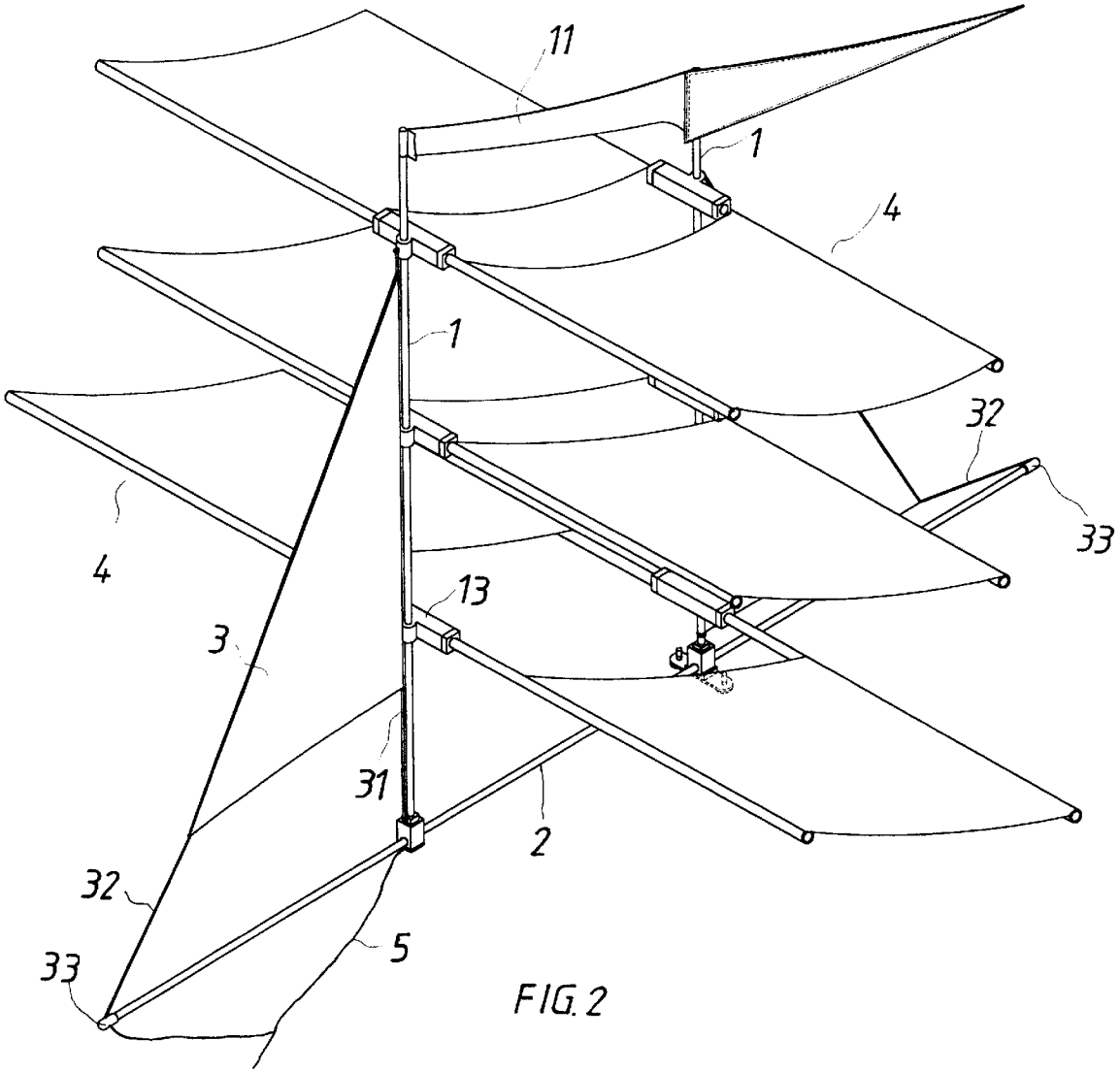
FIG. 2 is a perspective view of the 3D kite of the present invention.

A referred embodiment of a 3D kite in the present invention, as shown in FIG. 1, includes two upright rods 1 of different length connected at upper ends with cloth strips (or ropes) 11, a horizontal rod 2 fixed with the lower ends of the two upright rods 1, a sail 3 respectively bound on the two upright rods 1, and a plurality of wings 4 fixed between the two upright rods 1 as main components.

Figure 6:
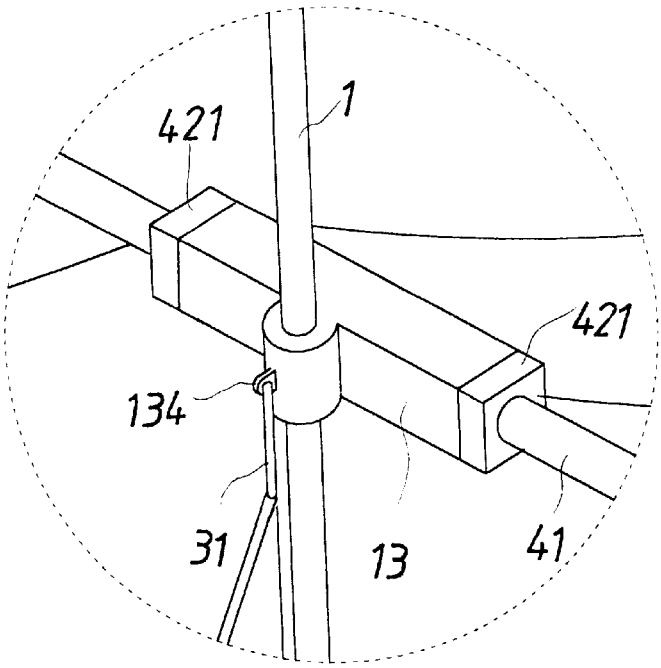
FIG. 6 is another partial enlarged view of the 3D kite of the present invention.
Figure 5:
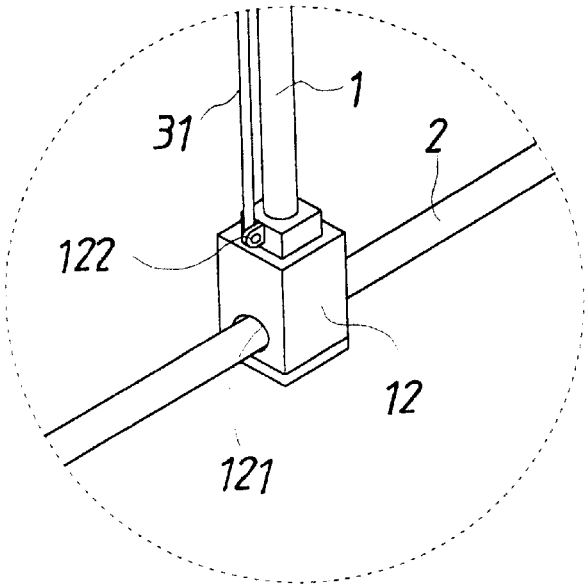
FIG. 5 is another partial enlarged view of the 3D kite of the present invention.

As shown in FIG. 5, the two upright rods 1 respectively have a connector 12 fixed at the lower end, and the connector 12 is provided with a lateral hole 121 for the horizontal rod 2 to pass through, and a ring 122 provided on an upper side for binding a tightening string 31 of each sail 3 thereon. A plurality of hooking sockets 13 are fixed and spaced apart horizontally on each upright rod 1, respectively formed with an inverted U-shaped portion 131 having an inner groove 132 and a projecting ridge 133 at an inner edge, and a ring 134 formed at an opposite side of the inverted U-shaped portion for the other end of the tightening string 31 of each sail 3 to be tied thereon, as shown in FIG. 6.

The horizontal rod 2 has a proper length and passes through the lateral holes 121 of the two connectors 12 of the two upright rods 1.

Each sail 3 is shaped triangular, having a tightening string 31 on the side along the upright rod 1, and the tightening string 31 has two ends respectively tied on the ring 122 of the connector 12 and the ring 134 of the hooking socket 13. Further, another tightening string 32 is sewn at a outer corner of the sail, having its end tied with an insert block 33 to be inserted in an end end of the horizontal rod 2.

Figure 4:
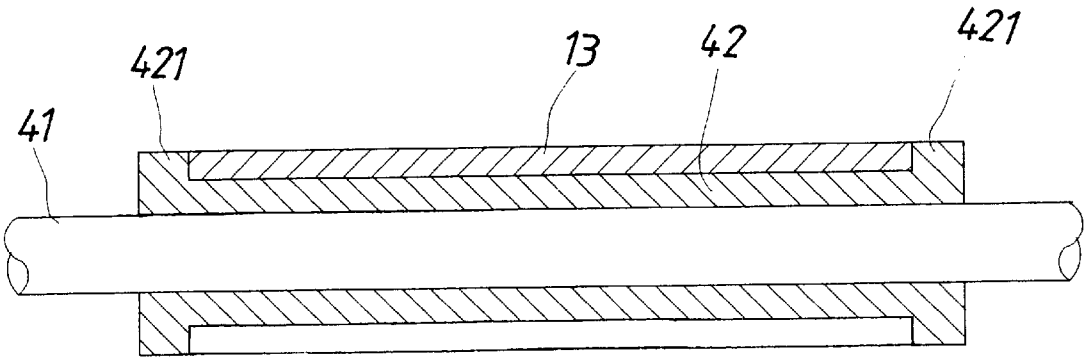
FIG. 4 is another partial enlarged view of the 3D kite of the present invention.
Figure 3:
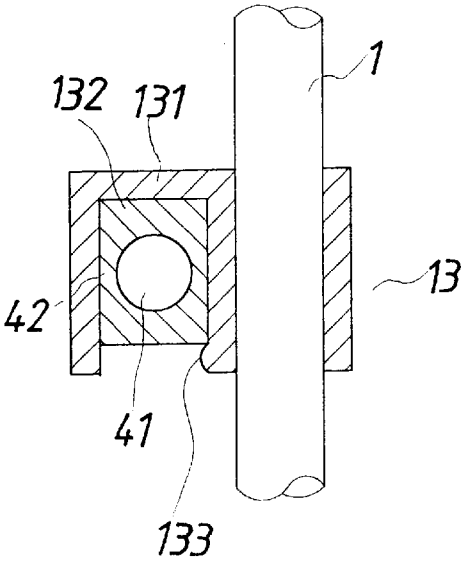
FIG. 3 is a partial enlarged view of the 3D kite of the present invention.

Each wing 4 has two parallel rods 41, an rectangular insert bar 42 fixed around an intermediate portion of each rod 41, and each rectangular insert bar 42 has a flange 421 formed respectively at two ends, as shown in FIGS. 3 and 4. Further two canvasses 41 are fixed between each two parallel rods 41, and space apart, with a hollow intermediate space formed between the two canvasses 41.

In assembling, firstly, the tightening strings 31 of the sails 3 are tied with the rings 122, 134 of the connectors 12 and the hooking sockets 13. Next, the horizontal rod 2 is inserted through the lateral holes 121 of the connectors 12, and the two insert blocks 33 of the two sails 3 are inserted firmly in the two ends of the horizontal rod 2, permitting the cloth strips 11 stretched. Then the two upright rods 1, the horizontal rod 2 and the sails 3 are secured with one another. After that, each wing 4 is combined with the upright rods 13, with the two insert bars 42 engaged the inverted U-shaped grooves 132 of the two hooking sockets 13, and with the projecting ridge 133 hampering the insert bar 42 from falling off the hooking sockets 13. At the same time, after the insert bar 42 engages the hooking socket 13, the two flanges 421 of each insert bar 42 prevent the insert bar 42 from moving right and left. Finally, a Y-shaped string 5 is tied on a proper location of the horizontal rod 2, finishing assemblage of the present 3D kite.

Figure 7:
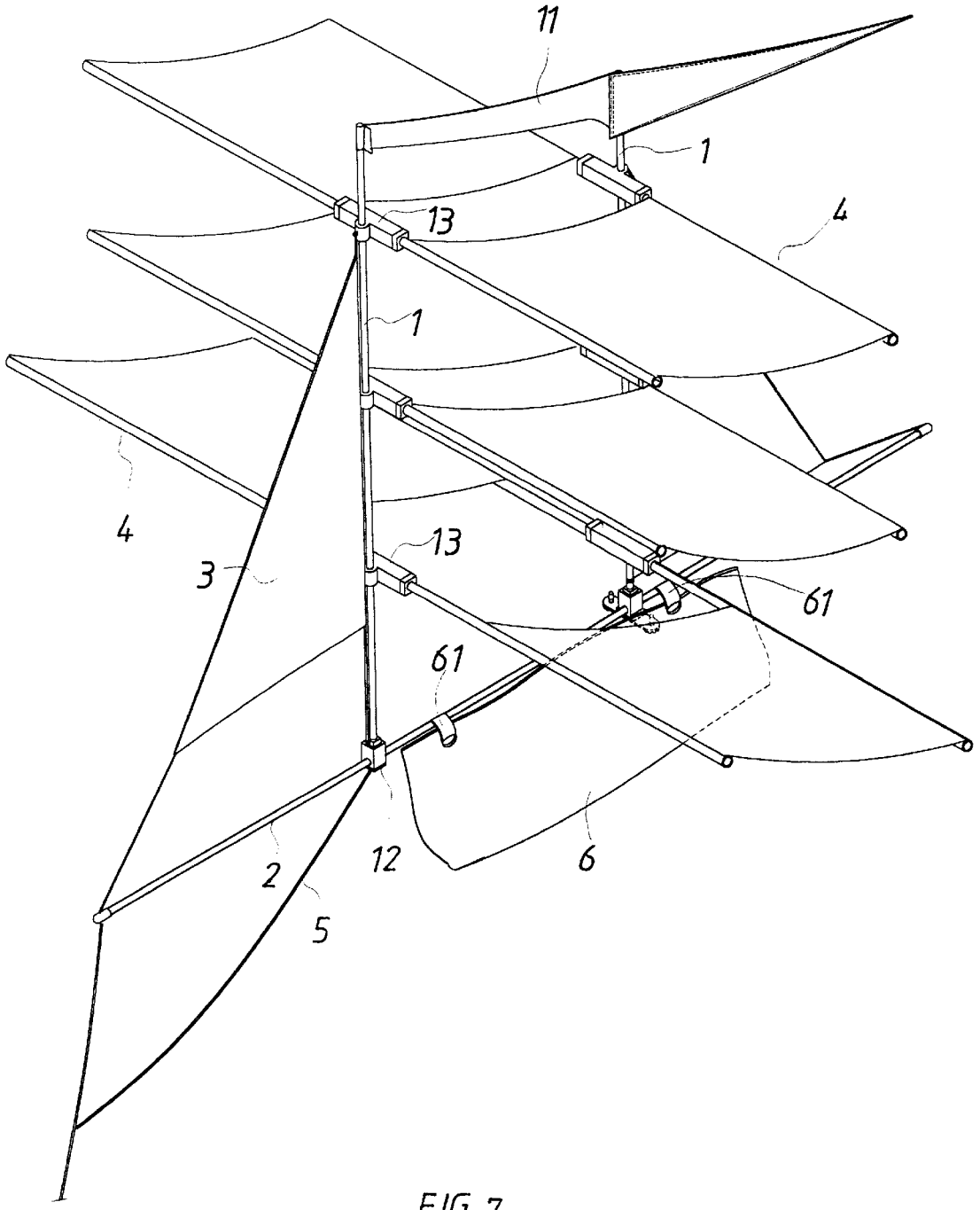
FIG. 7 is a first embodiment of a 3D kite of the present invention.
Figures 8, 9:
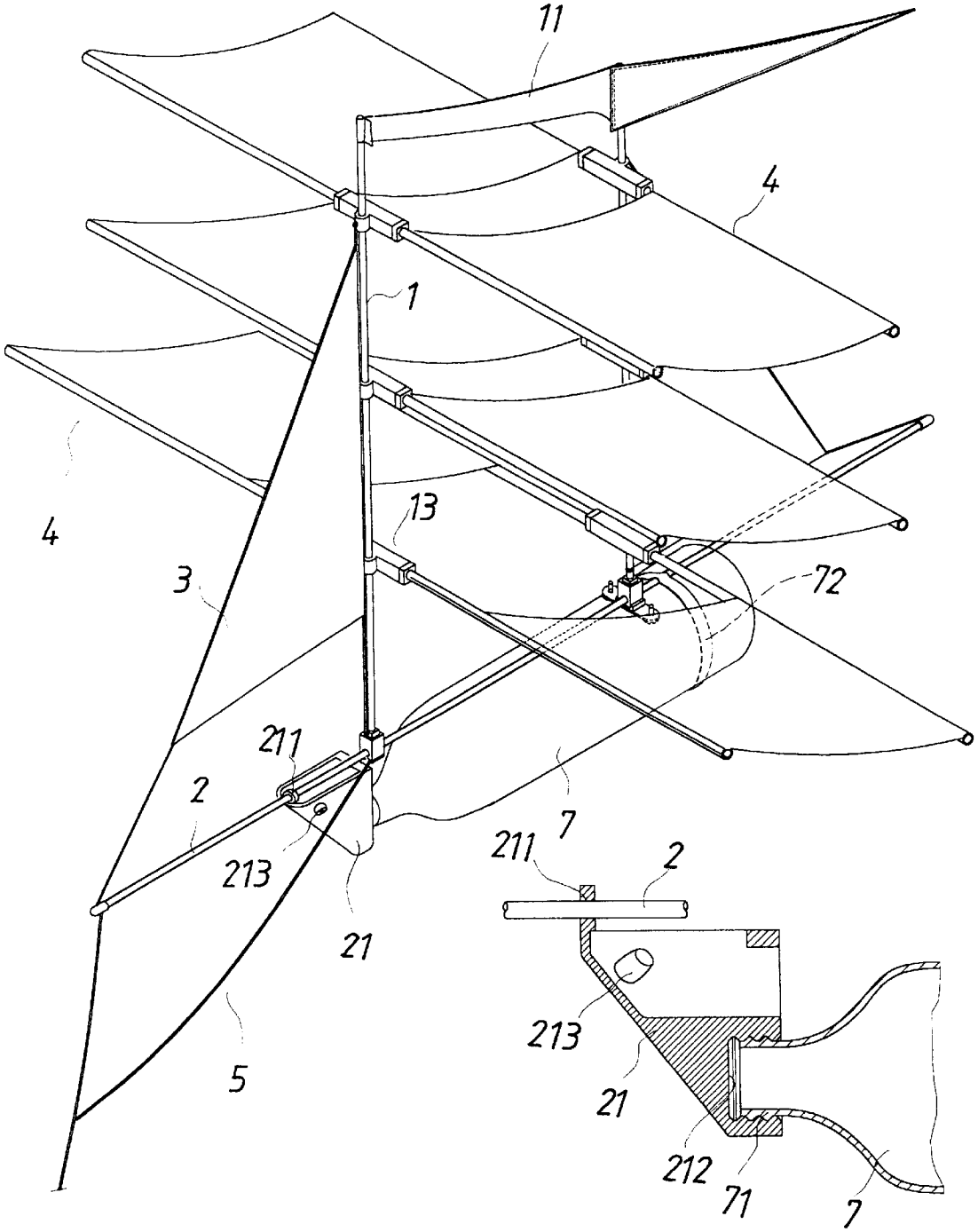
FIG. 8 is a second embodiment of a 3D kite of the present invention.
FIG. 9 is a partial cross-sectional view of FIG. 8.

The 3d kite in the present invention can be combined with an advertisement, as shown in FIG. 7, further including a sheet of paper 6 tied on the horizontal rod 2 by means of bands 61, with advertising words or a design printed on the paper. Further, as shown in FIGS. 8 and 9 wherein a second embodiment is shown, in another way of advertisement, a decorative block 21 is added to the front portion of the horizontal rod 2, having a ring 211 on an upper side for the horizontal rod to pass through and a threaded hole 212 formed in a vertical rear side for a threaded front end of a bottle-shaped body 7 to engage with. The bottle-shaped body 7 has its rear end tied on the horizontal rod 2 by means of a band 72 so as to secure the bottle-shaped body 7 under the horizontal rod 2. And the bottle-shaped body 7 is a means of an advertisement (for example, for Coca Cola).

Figures 10, 11:
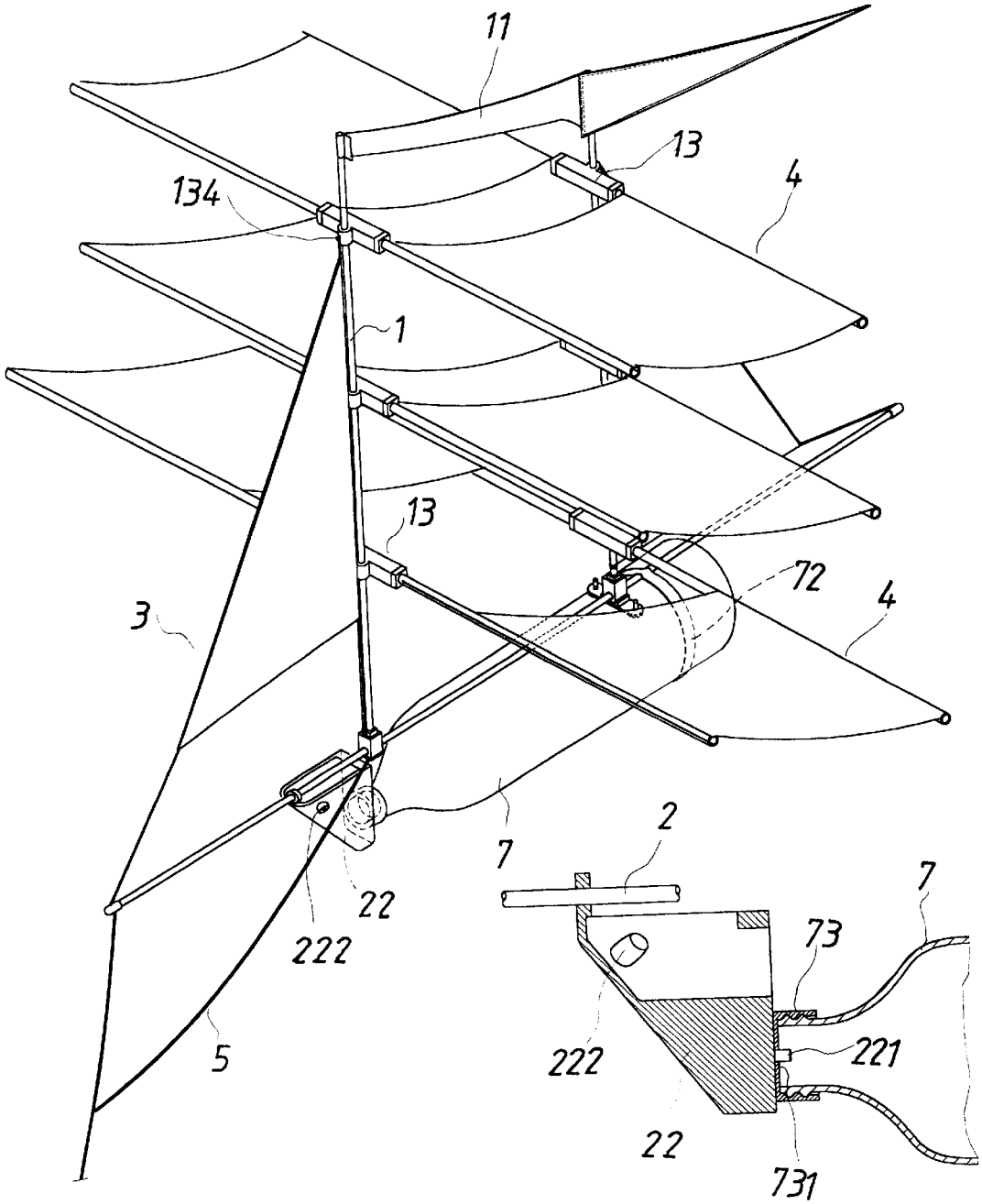
FIG. 10 is a third embodiment of a 3D kite of the present invention.
FIG. 11 is partial cross-sectional view of FIG. 10.

A third embodiment of the invention, the bottle-shaped body 7 tied under the horizontal rod 2, as shown FIGS. 10, 11, may have a projection 221 on the rear side of a decorative block 22, fitting in a hole 731 formed in a cap 73 of the bottle-shaped body 7 so as to secure the bottle-shaped body 7 under the horizontal rod 2.

Figure 12:
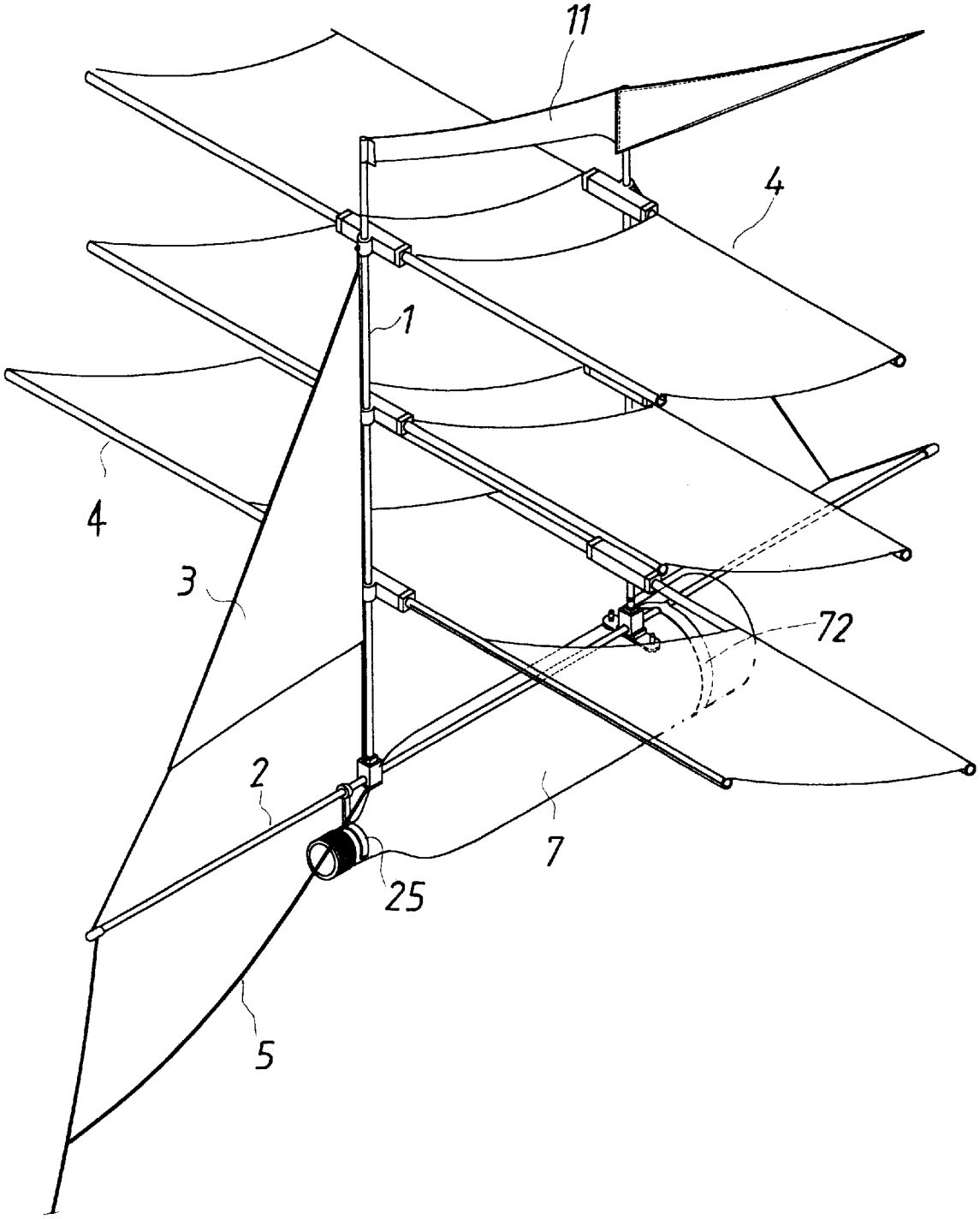
FIG. 12 is a fourth embodiment of a 3D kite of the present invention.

Further, a C-shaped clamp 25 may be used instead of the decorative block 22 in FIGS. 10, 11 so as to secure the front end of the bottle-shaped body 7, as shown in FIG. 12, wherein a fourth embodiment is shown.

Figure 13:
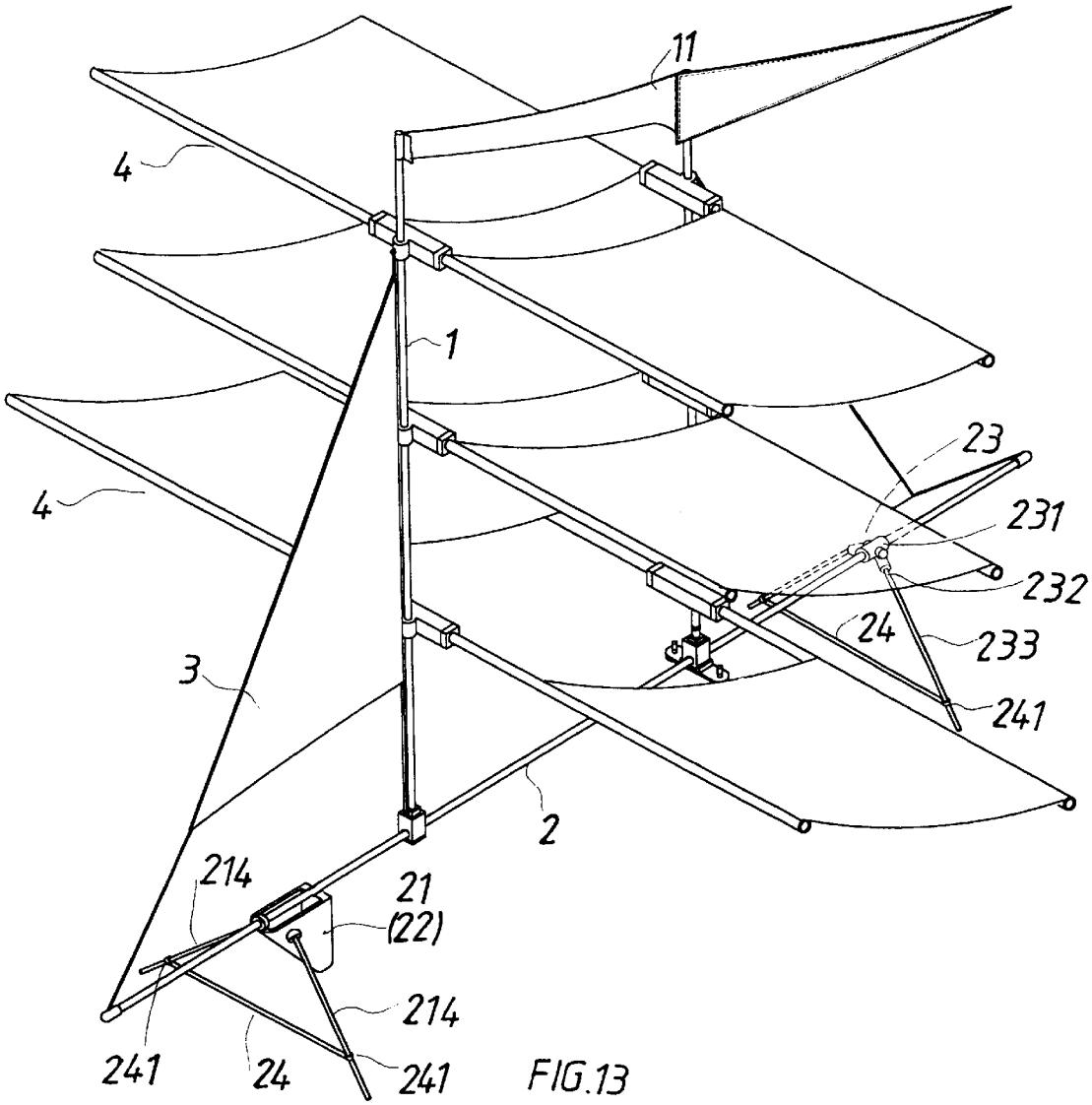
FIG. 13 is a fifth embodiment of a 3D kite of the present invention.
Figure 14:
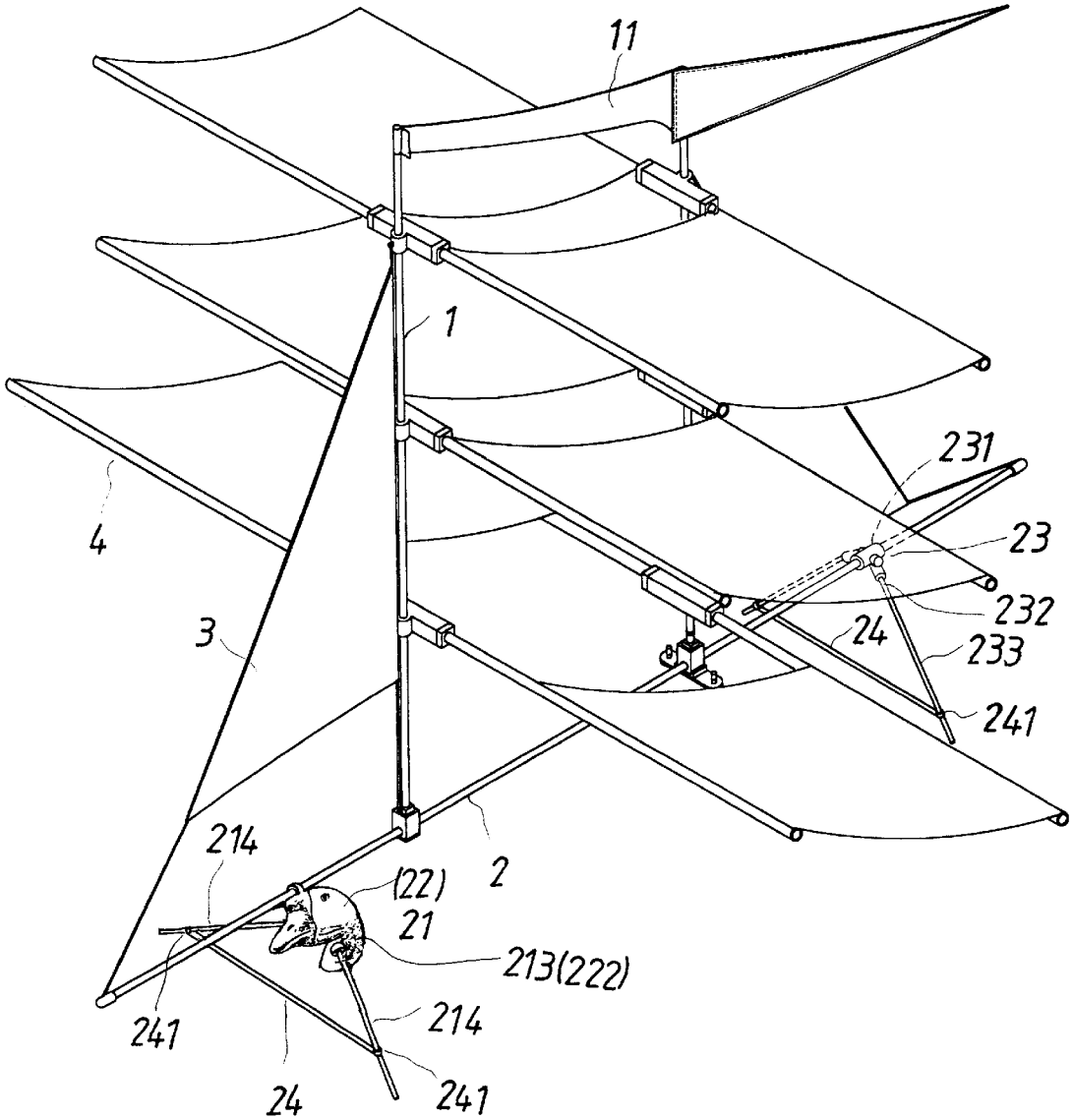
FIG. 14 is a sixth embodiment of a 3D kite of the present invention.
Figure 15:
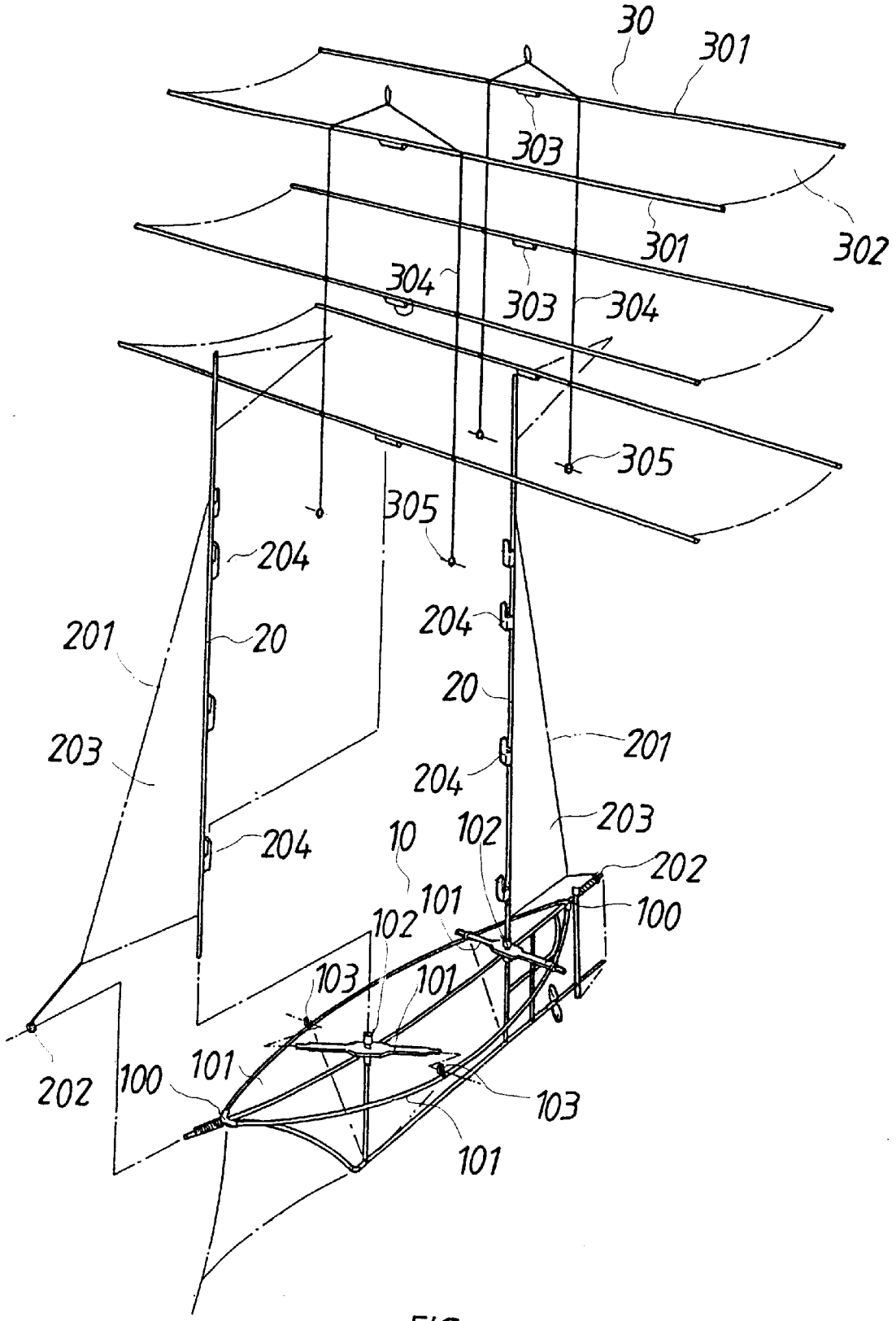
FIG.15 (PRIOR ART)
FIG. 15 is a perspective view of a known conventional 3D kite.

Further, as shown in FIGS. 13, 14, a fifth and a sixth embodiment of a 3D kite respectively have a decorative block 21, 22 combined on a front portion of the horizontal rod and provided with an insert hole 213, 222 in opposite two sides respectively for inserting support rods 214 therein. Then a support base 23 is combined on a rear portion of the horizontal rod 2, having a ring 231 fitting around the horizontal rod 2 and having two opposite insert holes 232 for two support rods 233 to insert a little therein. Thus, the whole 3D kite may be stood on a flat floor or ground by means of the support rods 214, 233 for advertising, in case that the 3D kite is not used for flying in the sky.

In order to prevent the support rods 214, 233 from inclining outward due to the gravity, a limit rod 24 may be added between the two support rods 214, 233 by means of a ring 241 formed at two ends of the limit rod 24 for the end of the support rods 214, 233 to fit through, limiting an angle formed by the two support rods 214, 233.

Generally speaking, the 3D kite in the present invention can chiefly used for flying in the sky in an amusement of leisure activity, and can be added with a advertising paper or a bottle-shaped body for advertising, if necessary. Further, it can be used solely for decoration or advertisement, by adding a decorative block and a support base to the horizontal rod for securing the 3D kite on a flat floor or ground for means of decoration or advertisement.

What is claimed is:

1. A 3D kite comprising two upright rods of different length connected with a cloth strip bound on upper ends of said upright rods, a horizontal rod connected to lower ends of said upright rods, a sail attached on an outer side of each said upright rod and having its outer corner connected a string having an end bound with an insert means, said insert means inserted respectively in two ends of said horizontal rod, a plurality of horizontal wings fixed spaced apart between said two upright rods, and characterized by each said wing consisting of two parallel rods, two insert bars and two canvasses, each said insert bar fixed around an intermediate portion of each said parallel rod and having a flange respectively formed at two ends, said two canvasses stretched among said two parallel rods, a plurality of hooking sockets fixed spaced apart on each said upright rod, each said hooking socket having an inverted U-shaped portion provided with an inner groove, said inverted U-shaped portion having a projecting ridge formed on an inner wall edge, said projecting ridge preventing said insert bar of said wing from loosening off after each said insert bar is inserted in each said inverted U-shaped portion of said hooking sockets so as to secure said wings on said two upright rods to form the 3D kite.

2. The 3D kite as claimed in claim 1, wherein a connector is fixed on a lower end of each said upright rod, having a lateral hole for said horizontal rod to pass through.

3. The 3D kite as claimed in claim 1, wherein each said connector further has a ring on an upper side, and the upper most one of said hooking sockets has a ring, each said sail has a tightening string along the side facing said upright rod so that two ends of said tightening string are respectively tied to said ring of each said connector and each said hooking socket.

4. The 3D kite as claimed in claim 1, wherein each said hooking socket has a U-shaped portion instead of said inverted U-shaped portion, and said U-shaped portion is an inner groove opening upward.

5. The 3D kite as claimed in claim 1, said two upright rods have upper ends connected with a rope.

6. The 3D kite as claimed in claim 1, wherein a sheet of paper printed with advertising words is hung under said horizontal rod between said two upright rods.

7. The 3D kite as claimed in claim 1, wherein a front portion of said horizontal rod has a decorative block fixed thereon, which has a hole formed in a rear side for a front end of a bottle-shaped body to fit firmly therein, a rear end of said bottle-shaped body is tied on said horizontal rod by means of a band, and thus said bottle-shaped body is secured under said horizontal body for advertising function.

8. The 3D kite as claimed in claim 1, wherein a front portion of said horizontal rod has a decorative block fixed thereon, which has a projecting on a rear side fitting in a cap of a bottle-shaped body having advertising function, and has its rear end tied on said horizontal rod so as to be secured on said horizontal rod.

9. The 3D kite as claimed in claim 7 or 8, wherein said decorative block has an insert hole respectively in two opposite sides.

10. The 3D kite as claimed in claim 9, wherein a limit rod is fixed between said two support rods for securing the angle between said two support rods.

11. The 3D kite as claimed in claim 10, wherein said limit rod has a ring formed at two ends for said support rod to fit therein.

12. The 3D kite as claimed in claim 1, wherein said horizontal rod has a decorative block and a support base respectively at two ends, said decorative block and said support base respectively have a ring for said horizontal rod to pass through and an inclined insert holes respectively at two opposite sides for said support rod to fit therein, and then said 3D kite can be wholly placed securely on a flat floor or ground.

13. The 3D kite as claimed in claim 12, wherein a limit rod is fixed between said two support rods of said decorative block and said support base, limiting and securing the angle between said two support rods.

14. The 3D kite as claimed in claim 13, wherein said limit rod has a ring formed respectively at two ends for each said support rod to fit therein firmly.

15. The 3D kite as claimed in claim 1, wherein said horizontal rod has its front end provided with a clamp for clamping a front end of a bottle-shaped body, which has its rear end tied on said horizontal rod with a band so as to secure said bottle-shaped body to said 3D kite.

* * * * *